United States Patent [19]

Netschert

[11] 3,937,394

[45] Feb. 10, 1976

[54] HANDLE FOR PAPER BAG

[76] Inventor: Carl O. Netschert, 633 Tularosa Drive, Los Angeles, Calif. 90026

[22] Filed: Jan. 27, 1975

[21] Appl. No.: 544,408

[52] U.S. Cl. ..... 229/54 R; 16/125; 24/30.5 R; 150/12; 223/91; 223/96; 224/45 H; 224/45 W; 229/65

[51] Int. Cl.[2] ..... B65D 33/06

[58] Field of Search ..... 229/65, 54 R; 223/96, 87, 223/90, 91; 16/125; 24/30.5 R; 150/12; 224/45 H, 45 P, 45 W

[56] References Cited

UNITED STATES PATENTS

| | | | |
|---|---|---|---|
| 644,038 | 2/1900 | Whalley | 229/54 R |
| 905,498 | 12/1908 | Claussen | 223/91 |
| 1,079,527 | 11/1913 | Wallace | 229/62 X |
| 1,792,236 | 2/1971 | Olson | 223/91 |
| 2,854,717 | 10/1958 | O'Forrell et al. | 229/65 X |

FOREIGN PATENTS OR APPLICATIONS

| | | | |
|---|---|---|---|
| 12,298 | 5/1912 | United Kingdom | 24/30.5 R |
| 8,027 | 6/1932 | Australia | 24/30.5 R |

*Primary Examiner*—George E. Lowrance
*Assistant Examiner*—Stephen P. Garbe
*Attorney, Agent, or Firm*—Paul A. Weilein

[57] ABSTRACT

A resilient wire is bent to the form of an elongated closed loop having parallel upper and lower sides. The upper side of the closed loop serves as a handle to be gripped by the user. The opposite ends of the wire overlap along the length of the lower side of the closed loop and cooperate to clamp the upper end of a paper bag.

9 Claims, 10 Drawing Figures

HANDLE FOR PAPER BAG

BACKGROUND OF THE INVENTION

Cammett et al U.S. Pat. No. 824,904, Emerson U.S. Pat. No. 1,399,707 and Weston U.S. Pat. No. 2,716,516 each discloses a carrying handle which may releasably clamp the folded upper end of a paper bag to support the paper bag and its contents.

The Cammett et al device serves its purpose but is relatively expensive to manufacture. The device comprises a handle member of wood or the like on which are pivotally mounted two separate U-shaped wire bails. The two wire bails are of complicated shape with loops at their opposite ends that rotatably seat in corresponding circumferential grooves in the handle member.

The Emerson device is a garment hanger made of wire which is intended to clamp the upper end of a garment. Unfortunately, however, the clamping action is inefficient, being substantially weaker at one end of the clamping zone than at the other end, with the consequence that the structure would not be reliable for carrying a paper bag.

The Weston device does not depend on clamping action to hold a paper bag but instead has two spaced sharp prongs to pierce the folded portion of a paper bag. The strain on the bag material is concentrated at the two spaced prongs and the piercing of the bag material by the two prongs may tend to cause the bag to tear.

It is apparent that there is need for a carrying handle that is both inexpensive and easy to operate and at the same time is capable of gripping a paper bag effectively.

SUMMARY OF THE INVENTION

A single piece of resilient wire is bent to form a closed elongated rectangular loop having relatively long parallel upper and lower sides. The upper side of the closed rectangular loop serves as a handle for the user and preferably is encased by a tubular handle member for this purpose. The lower side is formed by two coextensive oppositely directed ends of the single piece of wire, these two oppositely directed ends cooperating to releasably clamp the upper end of a bag, for example, a paper bag.

One of the two coextensive opposite ends of the wire is a flexible clamp arm and the other may be termed a cross rod that is bent to form a terminal eye that embraces the base portion of the clamp arm to complete the closed rectangular loop. The free end of the clamp arm is bent to form a latch to releasably engage the cross rod for the desired clamping action on the upper end of a bag.

With the handle device in its normal upright bag-carrying position and with the clamp arm latched to the cross rod, the clamp arm is adjacent the upper side of the cross rod and the paper bag is folded back on itself with the fold enveloping the clamp arm and with the lower cross rod keeping the bag folded against itself. Thus, the weight of the bag pulls the clamp arm downward against the cross rod to tend to tighten the clamping action on the bag. The result is that the clamping action is of uniform effectiveness across the width of the bag.

When the handle device is observed in its normal upright position in engagement with the upper end of a paper bag, it would be naturally thought that maneuvering the upper end of the paper bag into its clamped position at which it enfolds the clamp arm would be a tedious, time-consuming and somewhat ackward operation. An important feature of the invention, however, is that the construction of the device makes possible a simple procedure for quickly and effectively maneuvering the upper end of a bag into the desired self-tightening engagement with the device.

This simplified procedure is based on a combination of three concepts. The first concept is to bias the free end of the unlatched clamp arm away from the cross rod to form with the cross rod a slot that is open at one side of the handle device to permit the flat upper end of a paper bag to be inserted edgewise into position between the clamp arm and the cross rod. The second concept is to insert the upper end of the paper bag edgewise into the slot while the handle device is in upside down position and then latching the free end of the clamp arm to grip the paper bag between the clamp arm and the cross rod so that subsequent rotation of the reversed handle device approximately 180° to its normal upright position causes the upper end of the paper bag to enfold the latch arm and to cause the cross rod to keep the paper bag folded against itself. The third concept is a particular placement of the clamp arm relative to the cross rod when the clamp arm is unlatched at its slot-forming position while the handle device is turned upside down. The unlatched clamp arm of the upside down device not only diverges from the cross rod laterally thereof to form the bag-receiving slot, but is also below the level of the cross rod. The act of latching the clamp arm to the cross rod when the device is upside down shifts the position of the clamp arm to the underside of the cross rod to press the paper bag against the underside of the cross rod and in doing so to form a preliminary bend in the paper bag as a first step in the folding of the paper bag back on itself. The final step of rotating the inverted handle device 180° to its normal upright position completes the folding of the paper bag back on itself and places the cross rod below the clamp arm to keep the paper bag folded against itself.

The various features and advantages of the invention may be understood from the following detailed description and the accompanying drawing.

BRIEF DESCRIPTION OF THE DRAWING

In the drawing, which is to be regarded as merely illustrative.

DESCRIPTION OF THE PRESENTLY PREFERRED EMBODIMENT OF THE INVENTION

Figure 1:
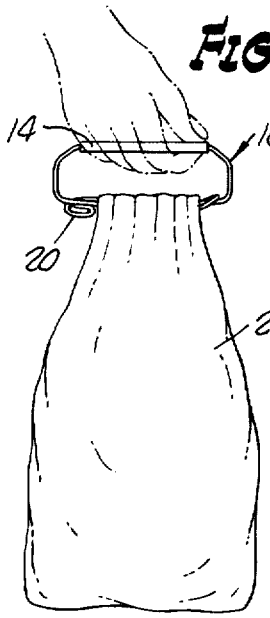
FIG. 1 is an elevational view showing how the handle device engages the upper end of a paper bag for the purpose of carrying the paper bag.
Figure 3:
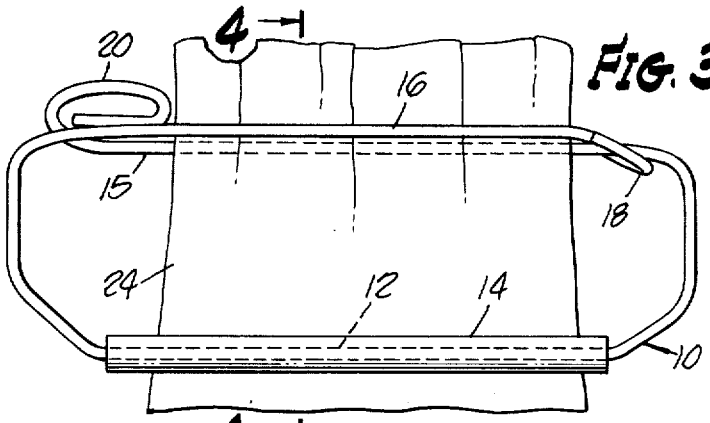
FIG. 3 is an elevational view showing the upper end of a paper bag inserted into the slot that is shown in FIG. 2.
Figure 5:
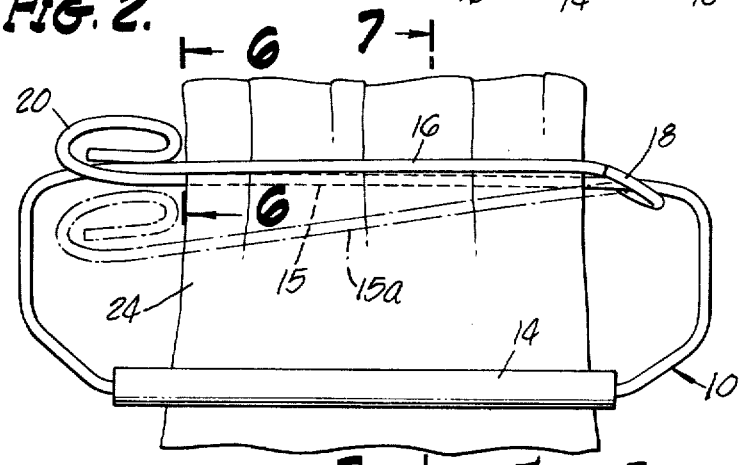
FIG. 5 is an elevational view similar to FIG. 3 showing the clamp arm shifted into latched engagement with the cross rod for the purpose of pressing the paper bag against the cross rod and of simultaneously forming a preliminary bend in the paper bag.
Figure 9:
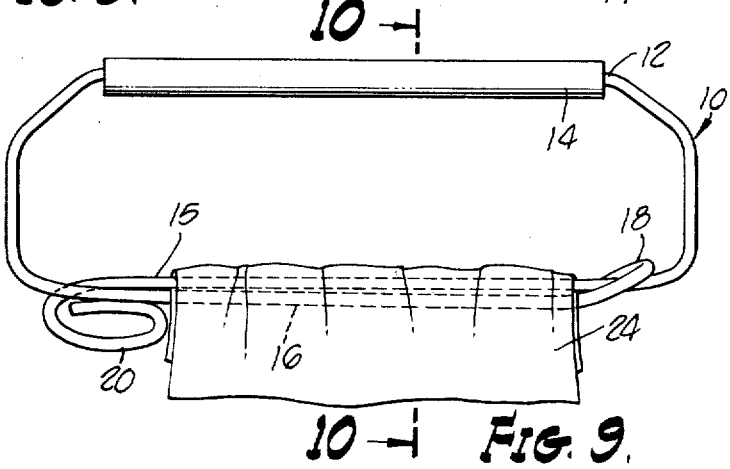
FIG. 9 is an elevational view showing the result of rotating the handle device 180° from the inverted position shown in FIGS. 5, 7 and 8 to the normal upright position of the handle device shown in FIG. 1.

FIGS. 1 and 9 show the handle device in its normal upright position and FIGS. 3 and 5 show the handle device in its temporary upside down position.

The handle device consists essentially of a single piece of resilient wire, generally designated by numeral 10, which is bent into the form of a closed elongated rectangular loop. The portion 12 of the wire that forms the upper side of the rectangular loop when the handle device is in its normal upright position serves as the handle of the device and preferably is encased by a tubular member 14 which may be made of a suitable plastic and which promotes the comfort of the user of the device.

The normal lower side of the elongated rectangular loop is formed by two oppositely directed substantially overlapped ends of the wire 10 that cooperate for the purpose of effectively clamping the upper end of a paper bag. One of these oppositely directed coextensive ends is a clamp arm 15 and the other is a cross rod 16 that is formed with a terminal eye 18 that loosely embraces the base of the clamp arm 15 to close the rectangular loop. It is important to note that at the upside down position of the device shown in FIGS. 3 and 5, the cross rod 16 lies above the clamp arm 15, whereas in the normal upright position of the handle device shown in FIG. 9, the clamp arm 15 lies above the cross rod 16.

Figure 2:
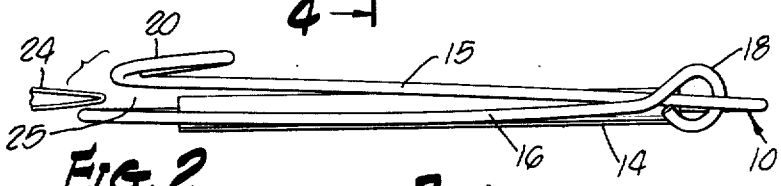
FIG. 2 is a plan view of the handle device in its upside down position showing how the unlatched clamp arm cooperates with the cross rod to form a slot that is open at one side of the device to permit the upper end of a paper bag to be inserted edgewise into the slot.
Figure 6:
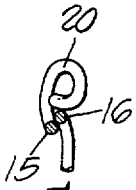
FIG. 6 is a section along the line 6—6 of FIG. 5 showing how the clamp arm makes latch engagement with the cross rod.

The free end of the clamp arm 15 is provided with suitable means for latching engagement with the cross rod 16 and in this instance the free end of the clamp arm is doubled back on itself twice to form a latch 20. FIG. 6 shows in cross section how the latch 20 may make releasable engagement with the cross rod 16. FIG. 5 shows in dotted lines at 15*a* an intermediate position of the clamp arm in its movement from the unlatched position shown in FIGS. 2 and 3 to the latched position shown in FIGS. 5 and 6. It is to be noted that the latch arm 15 shifts to the underside of the cross rod 16 in its movement to its latched position while the handle device is upside down.

The drawing illustrates the successive steps in the procedure for effectively engaging the handle device with the upper end of a paper bag that is generally designated by numeral 24. With the handle device turned upside down and with the clamp arm 15 in its free position, the clamp arm diverges from the cross rod 16 to form a slot 25 shown in FIG. 2 that is open at one end of the handle device. It is a simple matter to insert the upper end of the paper bag 24 edgewise into the slot to the position shown in FIG. 3. As shown in section in FIG. 4, the clamp arm 15 in its free position is positioned below the level of the cross rod 16 and is offset laterally therefrom to form the slot 25. By virtue of this arrangement, the upper end of the paper bag 24 may be easily inserted edgewise into the slot 25 and especially so since it is not necessary to bend the paper bag for the purpose of making the insertion.

Figure 8:
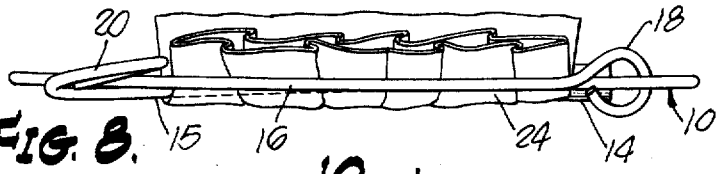
FIG. 8 is a plan view of the arrangement shown in FIG. 5.
Figure 7:
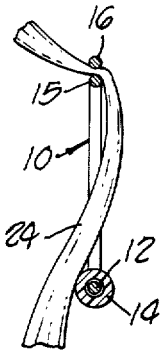
FIG. 7 is a vertical section along the line 7—7 of FIG. 5 showing the preliminary bend in the paper bag that is the consequence of latching the clamp arm to the cross rod.

The next step illustrated by FIG. 5 is to move the free end of the clamp arm 15 into a position at which the latch 20 of the clamp arm is in releasable engagement with the cross rod 16 as shown in section in FIG. 6. As indicated in FIGS. 7 and 8, the movement of the clamp arm 15 to its latched position immediately below the cross rod 16 at the upside down position of the device not only presses the upper end of the paper bag against the cross rod, but also forms a preliminary bend in the paper bag as shown in FIGS. 7 and 8. It is important to note that the clamp arm 15 lies close to the underside of the cross rod 16 throughout its length.

The eye 18 of the cross rod 16 serves as a guide for the clamp arm 15 and the inside diameter of the eye is sufficiently larger than the diameter of the cross rod 16 to permit the clamp arm to adjust itself to various thicknesses of the material that is gripped between the clamp arm and the cross rod. Thus, the handle device readily accommodates itself to upper ends of paper bags of various thicknesses.

Figure 10:
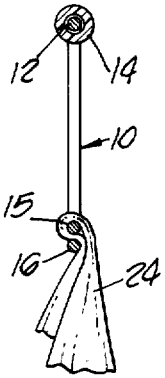
FIG. 10 is a vertical section along the line 10—10 of FIG. 9 showing the final disposition of the upper end of the paper bag at which the paper bag is folded back on itself over the now uppermost clamp arm with the now lowermost cross rod keeping the paper bag folded back on itself.

The final step is to rotate the handle device from the upside down position shown in FIG. 5 to the normal upright position shown in FIGS. 1 and 9. The consequence, which is illustrated by FIG. 10, is that the bag 24 enfolds the ltch arm 15 throughout the width of the paper bag, the paper bag being folded back on itself and being held in that folded state by the pressure of the cross rod 16 laterally against the folded bag. It is to be noted in FIG. 10 that with the latch member 15 positioned on the upper side of the cross rod 16 the weight of the paper bag 24 tends to pull the clamp arm down against the cross rod and thus tends to tighten the grip of the device on the paper bag. It is also to be noted in FIGS. 9 and 10 that the upper end of the paper bag is wrapped around the latch arm 15 throughout the width of the paper bag for uniform resistance to slippage of the paper bag.

Figure 4:
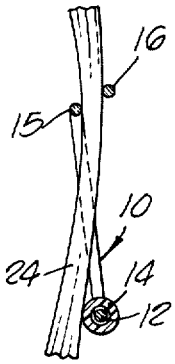
FIG. 4 is a vertical section taken along the line 4—4 of FIG. 3.

To release the handle device from the paper bag, the device is turned upside down to the position shown in FIGS. 5 and 7 and then the clamp arm 15 is unlatched from the cross rod 16. The unlatching of the clamp arm is accomplished by first moving the end of the clamp arm away from the cross rod sufficiently to free the clamp arm and then passing the clamp arm under the cross rod to the free position of the clamp arm that is shown in FIGS. 3 and 4. The inverted handle device is then shifted edgewise to the position shown in FIG. 2 to free the device from the bag 24.

My description in specific detail of the presently preferred embodiment of the invention will suggest various changes, substitutions and other departures from the disclosure within the spirit and scope of the appended claims.

I claim:

1. A handle device for releasable engagement with the upper end of a flexible object, for example a paper bag, comprising:

a resilient wire-like member bent to the form of a closed loop of generally rectangular configuration having substantially parallel upper and lower sides, the upper side of the closed loop serving as a carrying handle, the lower side of the closed loop being formed by substantially parallel and coextensive, oppositely directed overlapped ends of the wire-like member to cooperate with each other to clamp the upper end of the object, one of the two oppositely directed ends being a flexible clamp arm, the other of the two oppositely directed ends being a cross rod that terminally loosely engages the base of the clamp arm to complete the closed loop while permitting relative adjustment between the clamp arm and cross rod to various thicknesses of the object, the outer end of the clamp arm being equipped with latch means for releasable engagement with the cross rod for clamping action on the object, the clamp arm at its free position forming in cooperation with the cross rod a slot open at the free end of the clamp arm to permit the upper end of the object to be initially inserted edgewise into the slot into a position with the full width of the end of the object being folded over the clamp arm and extending back between the clamp arm and the cross rod, and the clamp arm in its latched position being operative under the weight of the object to pull the clamp arm downward in a manner to press the object against the cross rod with increased clamping force, and to cause the cross rod to keep the object folded against itself for effective weight-bearing engagement of the object by the handle device.

2. A handle device as set forth in claim 1 in which the whole length of the clamp arm at its latched position extends along the upper side of the cross rod when the handle device is in normal upright position and extends along the underside of the cross rod when the handle device is in upside down position, and with the handle device upside down and the end of the object having been inserted into said slot and the clamp arm latched, the handle device may then be rotated to its normal upright position to cause the enfoldment of the clamp arm by the end of the object bag.

3. A handle device as set forth in claim 1 in which the unlatched clamp arm is biased to diverge from the cross rod to form said slot.

4. A handle device as set forth in claim 1 in which the free end of the clamp arm is bent to form said latch means, the latch forming portion of the clamp arm being offset downward from the clamp arm when the handle device is in its normal upright position.

5. A handle device as set forth in claim 2, in which at the upside down position of the device, the unlatched clamp arm is biased to a position that is below the level of the cross rod and away from the cross rod laterally thereof to permit the upper end of the object to be inserted into the slot without substantial bending of the upper end of the object;

and in which the latching of the clamp arm while the handle device is in upside down position shifts the clamp arm to a position under the cross rod with consequent preliminary bending of the object towards its ultimate folded position that is accomplished by subsequently rotating the handle device to its normal upright position.

6. A handle device as set forth in claim 1 which includes a tubular member embracing the upper side of the closed loop to be gripped by the user of the handle device for the purpose of carrying the object.

7. A handle device as set forth in claim 5 in which the unlatched clamp arm is baised to diverge from the cross rod to form said slot.

8. A handle device as set forth in claim 7 in which the free end of the clamp arm is bent to form said latch means, the latch forming portion of the clamp arm being offset downward from the clamp arm when the handle device is in its normal upright position.

9. A handle device as set forth in claim 8 which includes a tubular member embracing the upper side of the closed loop to be gripped by the user of the handle device for the purpose of carrying the object.

* * * * *

UNITED STATES PATENT OFFICE

CERTIFICATE OF CORRECTION

PATENT NO. : 3,937,394

DATED : February 10, 1976

INVENTOR(S) : Carl O. Netschert

It is certified that error appears in the above-identified patent and that said Letters Patent are hereby corrected as shown below:

Column 3, line 38, the word --coextensive-- should appear before "overlapped".

Column 4, line 36, "ltch" should read --latch--.

Column 6, line 3, "bag" should be deleted.

Signed and Sealed this fourth Day of May 1976

[SEAL]

Attest:

RUTH C. MASON
*Attesting Officer*

C. MARSHALL DANN
*Commissioner of Patents and Trademarks*